US007982695B2

(12) United States Patent
Mizukoshi et al.

(10) Patent No.: US 7,982,695 B2
(45) Date of Patent: Jul. 19, 2011

(54) BRIGHTNESS UNEVENNESS CORRECTION FOR OLED

(75) Inventors: Seiichi Mizukoshi, Kanagawa (JP); Makoto Kohno, Kanagawa (JP); Kouichi Onomura, Yokohama (JP); Nobuyuki Mori, Saitama (JP)

(73) Assignee: Global OLED Technology, LLC., Wilmington, DE (US)

( * ) Notice: Subject to any disclaimer, the term of this patent is extended or adjusted under 35 U.S.C. 154(b) by 263 days.

(21) Appl. No.: 12/418,743

(22) Filed: Apr. 6, 2009

(65) Prior Publication Data

US 2009/0256854 A1 Oct. 15, 2009

(30) Foreign Application Priority Data

Apr. 15, 2008 (JP) ..... 2008-106025

(51) Int. Cl.
*G09G 3/30* (2006.01)

(52) U.S. Cl. ..... 345/76; 345/77; 345/690

(58) Field of Classification Search ..... 345/76–84, 345/89, 95–100, 204–215, 690
See application file for complete search history.

(56) References Cited

U.S. PATENT DOCUMENTS

| | | | | |
|---|---|---|---|---|
| 6,329,980 | B1 * | 12/2001 | Uehara et al. | 345/204 |
| 7,030,847 | B2 * | 4/2006 | Kimura | 345/92 |
| 7,345,660 | B2 | 3/2008 | Mizukoshi et al. | |
| 2007/0210996 | A1 | 9/2007 | Mizukoshi et al. | |
| 2007/0273701 | A1 | 11/2007 | Mizukoshi et al. | |

FOREIGN PATENT DOCUMENTS

JP 11-282420 10/1999

* cited by examiner

*Primary Examiner* — Vijay Shankar
(74) *Attorney, Agent, or Firm* — McKenna Long & Aldridge, LLP.

(57) ABSTRACT

Displaying an image with unevenness correction by measuring Vgs-Id characteristics of the transistors in a subset of pixels; approximating each characteristic using an equation of the form $$Id=(a(Vgs-b))^{c};$$

calculating a value c' using the approximations; measuring the characteristics of the remaining pixels; approximating each of those characteristics by an equation of the same form, using c' as the power for all of the approximations, calculating corrected image signals for each pixel using the respective approximations of the corresponding pixels of the display device to correct for unevenness; and applying the corrected image signals to the corresponding pixels of the display device to display a corresponding image with unevenness correction.

5 Claims, 12 Drawing Sheets

BRIGHTNESS UNEVENNESS CORRECTION FOR OLED

CROSS-REFERENCE TO RELATED APPLICATION

This application claims priority of Japanese Patent Application No. 2008-106025 filed Apr. 15, 2008 which is incorporated herein by reference in its entirety.

FIELD OF THE INVENTION

The present invention relates to unevenness correction data acquisition in an organic electroluminescence (hereinafter referred to as "EL") display device having an unevenness correcting function which corrects brightness unevenness during display by executing a calculation based on an input signal, and correction data for correcting variation of brightness among pixels during display.

Organic EL display devices which use organic EL elements as light emitting elements are known. In an organic EL element, an amount of emitted light changes depending on the current flowing, and in an active matrix organic EL display device, a thin film transistor (hereinafter referred to as "TFT") is used for controlling the amount of current.

FIG. 1 shows a basic structure of a circuit of a pixel (pixel circuit) in an active matrix organic EL display device, and FIG. 2 shows an example structure of a display device (display panel) and an input signal to the display device.

As shown in FIG. 1, the pixel circuit includes a selection TFT 2 having a source or a drain connected to a data line Data and a gate connected to a gate line Gate, a driving TFT 1 having a gate connected to the drain or the source of the selection TFT 2 and a source connected to a power supply PVdd, a storage capacitor C which connects between the gate and the source of the driving TFT 1, and an organic EL element 3 having an anode connected to the drain of the driving TFT 1 and a cathode connected to a low voltage power supply CV.

As shown in FIG. 2, a plurality of pixel sections 14 each having the pixel circuit shown in FIG. 1 are placed in a matrix form, to form a display section, and a source driver 10 and a gate driver 12 are provided for driving each pixel section in the display section.

An image data signal, a horizontal synchronization signal, a pixel clock, and other drive signals are supplied to the source driver 10, and the horizontal synchronization signal, a vertical synchronization signal, and other drive signals are supplied to the gate driver 12. The data line Data in the vertical direction extends from the source driver 10 for each column of the pixel sections 14 and the gate line Gate in the horizontal direction extends from the gate driver 12 for each row of the pixel sections 14.

The gate line (Gate) extending along the horizontal direction is set to a high level so that the selection TFT 2 is switched on, and a data signal having a voltage corresponding to a display brightness is supplied to the data line (Data) extending along the vertical direction in this state so that the data signal is accumulated in the storage capacitor C. With this process, a drive current corresponding to the data signal accumulated in the storage capacitor C is supplied by the driving TFT 1 to the organic EL element 3, and the organic EL element 3 emits light.

The current of the organic EL element 3 and the amount of emitted light are in an approximate proportional relationship. Normally, a voltage (Vth) at which a drain current starts to flow around a black level of the image is supplied between the gate and PVdd (Vgs) of the driving TFT 1. As an amplitude of the image signal, an amplitude which results in a predetermined brightness around a white level is used.

FIG. 3 shows a relationship between Vgs of the driving TFT 1 and a drain current Id. As shown in FIG. 3, the curve is not a straight line, and the offset voltage in which the current starts to flow and the slope can differ depending on the pixel. This is caused by variation in the Vth of the TFT which drives the pixel and in the mobility (μ), which results from a problem in manufacturing or aging deterioration.

In consideration of this, a method is proposed in which a γ correction circuit is provided to achieve a linear relationship between the image data and the brightness, and μ is corrected (gain correction) by multiplying the image data which drives each pixel by a predetermined value and Vth is corrected (offset correction) by adding a predetermined value.

For such a correction, the characteristic of the driving TFT is approximated with a function. When the characteristic is approximated with a function in which Id is proportional to the square (second power) of (Vgs−Vth) based on Equation 4 which is generally known and which will be described later. However, the error becomes large when Id is small, resulting in an inability to determine an accurate correction value.

SUMMARY OF THE INVENTION

In accordance with the present invention, there is provided a method of displaying an image with unevenness correction on an organic electroluminescence display device, comprising:

(a) providing the organic electroluminescence display device having a plurality of pixels, each including a transistor;

(b) measuring respective first Vgs-Id characteristics of the transistors in each of a selected first plurality of pixels;

(c) calculating one or more second Vgs-Id characteristics using the measured Vgs-Id characteristics;

(d) calculating one or more first approximation functions using the second Vds-Id characteristics, wherein each approximation function is defined by the equation having three values a, b and c:

$$Id=(a(Vgs-b))^c$$

for corresponding sets of values a, b and c calculated so that each first approximation function approximates the corresponding second Vds-Id characteristic;

(e) calculating a value c' using the one or more first approximation functions;

(f) measuring respective third Vgs-Id characteristics of the transistors in each of a selected second plurality of pixels;

(g) calculating, for each third Vgs-Id characteristic, a second approximation function using the corresponding third Vds-Id , wherein each second approximation function is defined by the equation having two values a' and b', and the value c' calculated in step (e):

$$Id=(a'(Vgs-b'))^{c'}$$

for corresponding sets of values a and b and the calculated value of c so that each second approximation function approximates the corresponding third Vds-Id characteristic;

(h) receiving an image data signal for each of the plurality of pixels;

(i) calculating a plurality of corrected image signals using the respective image data signals and the respective second approximation functions of the corresponding pixels of the display device to correct for unevenness; and (j) applying each corrected image signal to the corresponding pixel of the display device to display a corresponding image with unevenness correction.

According to one aspect of the present invention, there is provided a method of acquiring unevenness correction data for an organic electroluminescence display device having an unevenness correction function which corrects brightness unevenness during display by executing a calculation based on an input signal and correction data for correcting variation in brightness among pixels, wherein, during collection of the correction data, gate voltage-to-drain current characteristics (Vgs-Id characteristics) of thin film transistors of all pixels on a panel are approximated by a power function of $Id=(a(Vgs-b))^c$ wherein c is a value common to all pixels and a and b are unique to each pixel, and the correction data is determined.

According to another aspect of the present invention, there is provided an organic electroluminescence display device wherein unevenness correction data acquired through the above-described method is stored, and brightness unevenness is corrected during display by executing a calculation based on an input signal and the correction data.

According to another aspect of the present invention, there is provided a method of manufacturing an organic electroluminescence display device having an unevenness correction function in which the unevenness correction data is acquired through the above-described method, the acquired correction data is stored, and brightness unevenness is corrected during display by executing a calculation based on display data and the correction data.

With the present invention, correction data of brightness unevenness for an organic EL display can be precisely and efficiently acquired.

BRIEF DESCRIPTION OF THE DRAWINGS

Preferred embodiments of the present invention will be described in detail with reference to the drawings, wherein.

DETAILED DESCRIPTION OF THE INVENTION

Figure 4:
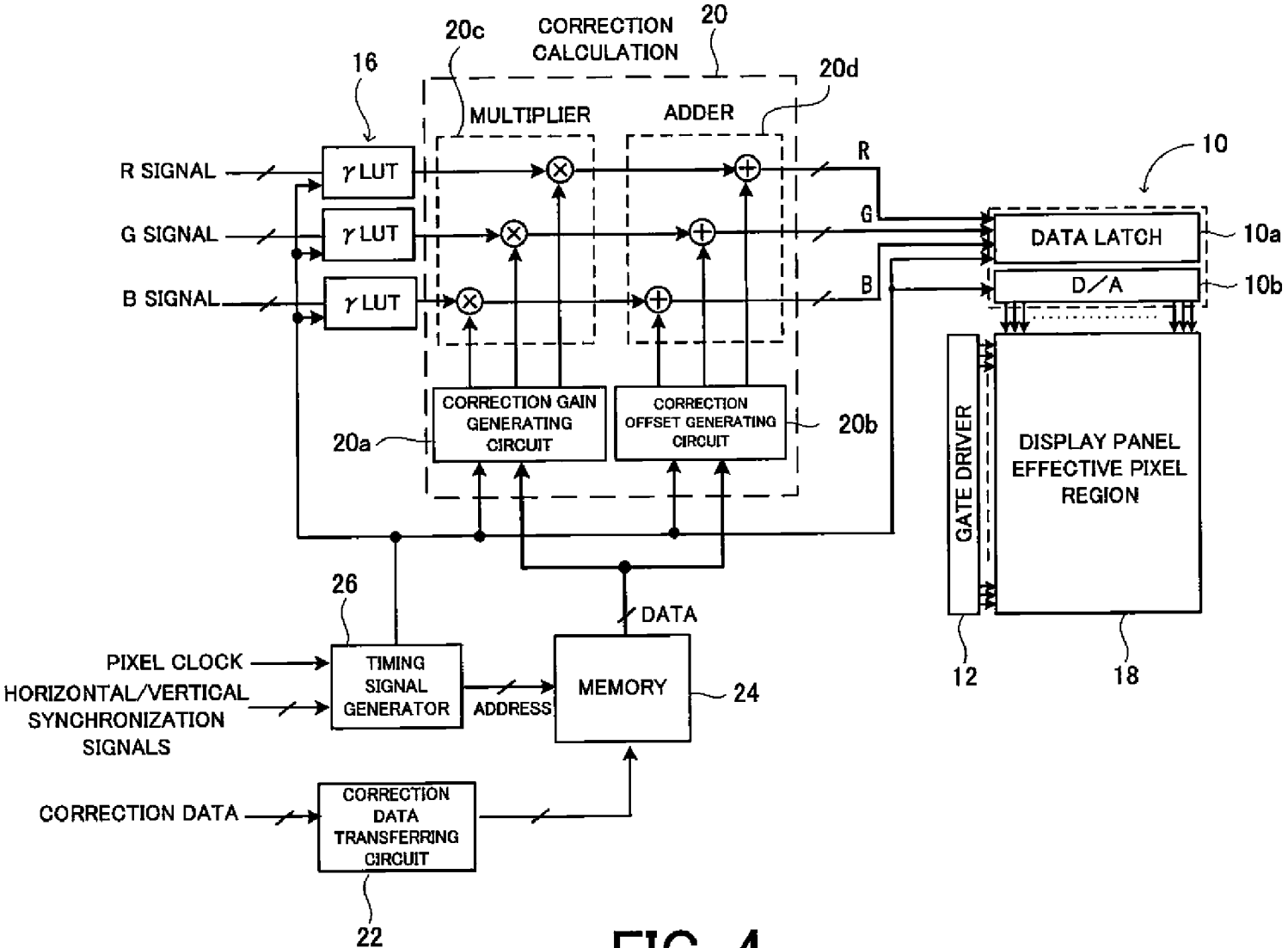
FIG. 4 is a diagram showing a structure for correcting image data.

A preferred embodiment of the present invention will now be described with reference to the drawings. FIG. 4 is a diagram showing an overall structure of a display device. As shown, in the present embodiment, a γ correction circuit (γLUT) 16 is provided so that the image data and the brightness are in a linear relationship, and at the same time, a correction calculating unit 20 is provided so that μ is corrected (gain correction) by multiplying signal data which drives each pixel by a certain value and Vth is corrected (offset correction) by adding a certain value.

An image data signal is a signal representing brightness of each pixel, and because the signal is a color signal, the image data signal includes image data signals for the colors. Therefore, three γ correction circuits 16 are provided corresponding to the colors of R, G, and B, and γ-corrected image data signals are output from the γcorrection circuits 16. The correction calculating unit 20 applies corrections of gain and offset on the γ-corrected image data signals.

Thus, the corrected image data signals are supplied to the source driver 10, further to the data line Data, and finally, to the pixel sections 14 for R display, for G display, and for B display. As shown in the figures, the source driver 10 includes a data latch 10*a* which temporarily stores the image data signal for each pixel, and a D/A 10*b* which latches image data signals of one horizontal line stored in the data latch 10*a*, simultaneously D/A converts the data of one horizontal line, and outputs the D/A converted signals. A region in which a plurality of the pixel sections 14 are arranged in a matrix form is shown in the figures as an effective pixel region 18 of the display panel, where the display based on the image data signals is realized.

In the example configuration of FIG. 4, correction data for each pixel which is stored in advance is supplied from a correction data transferring circuit 22 to a memory 24 at timings such as the startup of the power supply. During display, correction data corresponding to the input image data is read from the memory 24 according to a timing signal from a timing signal generating circuit 26 and is supplied to the correction calculating unit 20. The correction calculating unit 20 includes a correction gain generating circuit 20*a*, a correction offset generating circuit 20*b*, a multiplier 20*c*, and an adder 20*d*. Based on the correction data from the memory 24, the correction gain generating circuit 20*a* generates a correction gain which is multiplied to the image data in the multiplier 20*c*. Similarly, the correction offset generating circuit 20*b* generates a correction offset which is added to the image data in the adder 20*d*.

Figure 1:
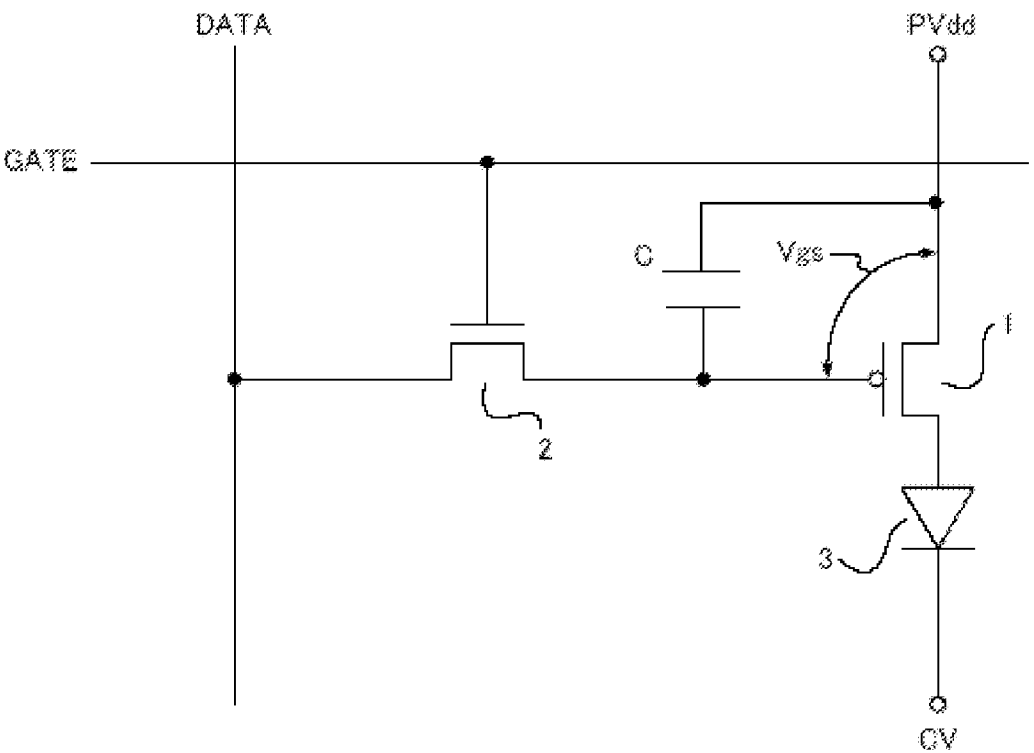
FIG. 1 Prior Art
FIG. 1 is a diagram showing an example basic structure of a circuit of one pixel (pixel circuit) in an active matrix organic EL display device.
Figure 2:
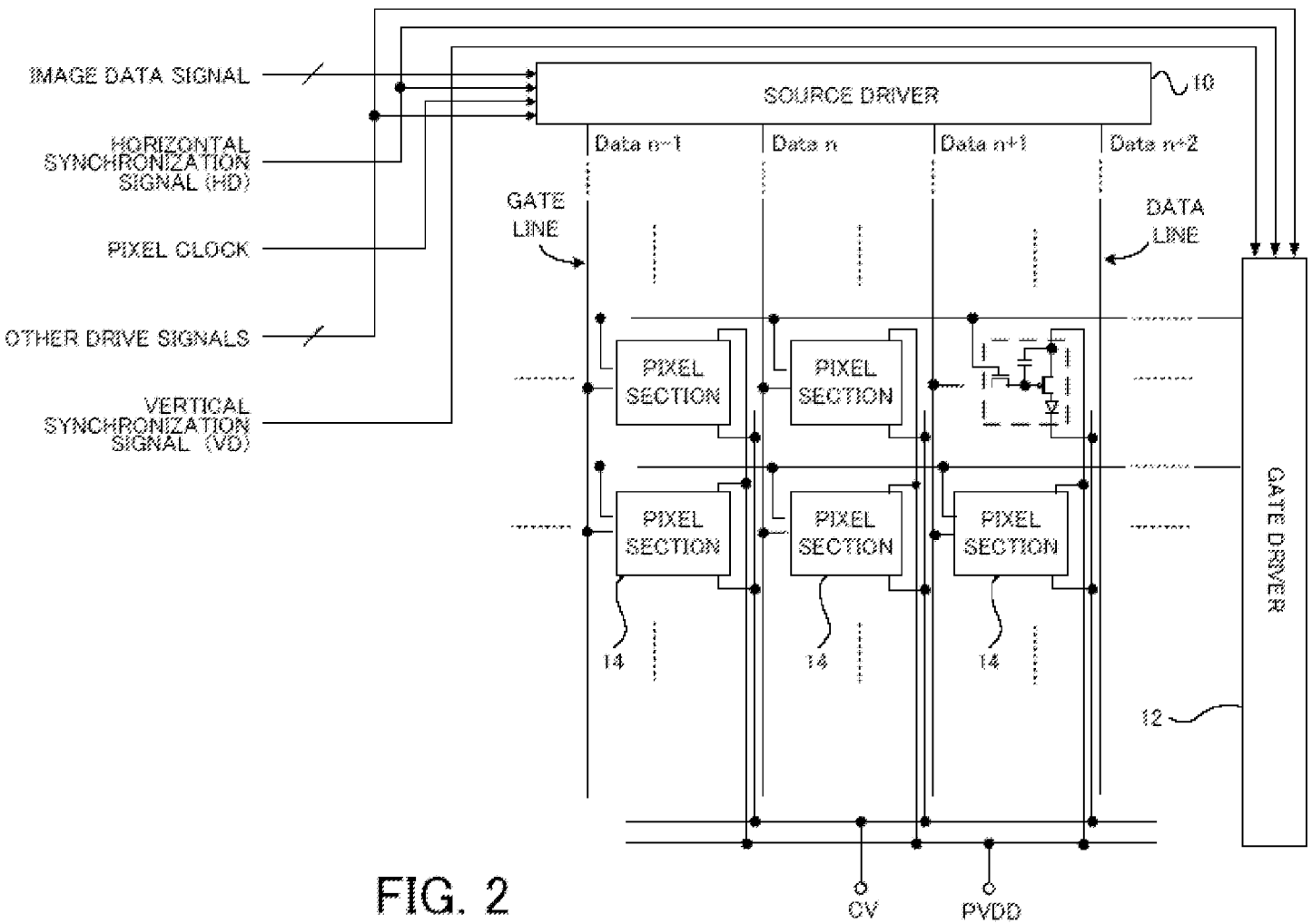
FIG. 2 Prior Art
FIG. 2 is a diagram showing an example structure of a display device and an input signal.
Figure 3:
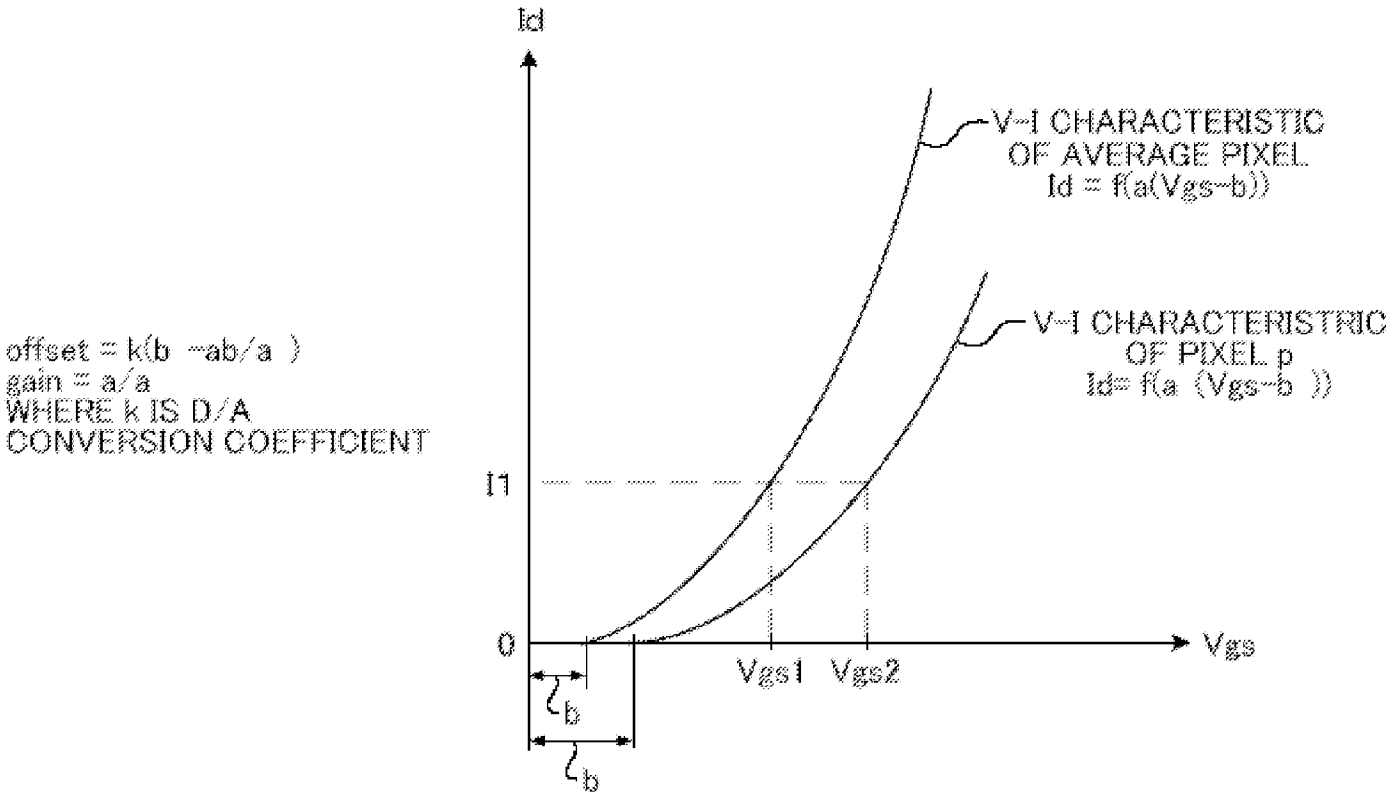
FIG. 3 Prior Art
FIG. 3 is a diagram showing a relationship of a drain current Id with respect to Vgs of the driving TFT 1.

A calculation method of the correction data will now be described with reference to FIG. 3. First, for a plurality of pixels, output currents corresponding to several input voltages are accurately measured, to determine a gate voltage-drain current characteristic (Vgs-Id characteristic) of an average pixel of the panel. Assuming that the curve can be represented by $I=f(a(Vgs-b))$, a function f(x) is determined. Assuming that all pixels of the panel can be represented by f(x) and the variation in the characteristics is caused by differences in coefficients a and b, the values of a and b for each pixel can be determined by measuring pixel currents corresponding to two or more input voltage levels.

If the Vgs-Id characteristic of a pixel p is represented by $Id=f(a'(Vgs-b'))$, in order to supply a drain current which is identical to a current I1 when a voltage of Vgs1 is input to an average pixel, a voltage Vgs2 which satisfies the following condition must be input.

$$I1=f(a(Vgs1-b))=f(a'(Vgs2-b')) \quad \text{[Equation 1]}$$

That is, voltage Vgs2 must satisfy the following condition.

$$a(Vgs1-b)=a'(Vgs2-b') \quad \text{[Equation 2]}$$

When the input data of the D/A converter for obtaining voltages Vgs1 and Vgs2 are d1 and d2 and a D/A conversion coefficient k is used which represents the relationship between input and output of the D/A conversion by V=kd, the following equation can be obtained from Equation 2.

$$d2=(a/a')d1+k(b'-(ab/a')) \quad \text{[Equation 3]}$$

In other words, the target current I1 can be obtained by multiplying d1 by a/a' as a gain and adding k(b'−(ab/a')) as an offset.

The function f(x) is an arbitrary function. However, the Vgs-Id characteristic of the TFT is generally known to follow the following equation in the saturation region.

$$Id=W\mu Ci(Vgs-Vth)^2/2L \quad \text{[Equation 4]}$$

wherein Vd>Vgs−Vth and Vgs>Vth.

In this equation, μ represents mobility, Ci represents a capacitance per unit area of a gate insulating film, Vth represents a threshold voltage, W represents a gate channel width, and L represents a gate channel length.

Figure 5B:
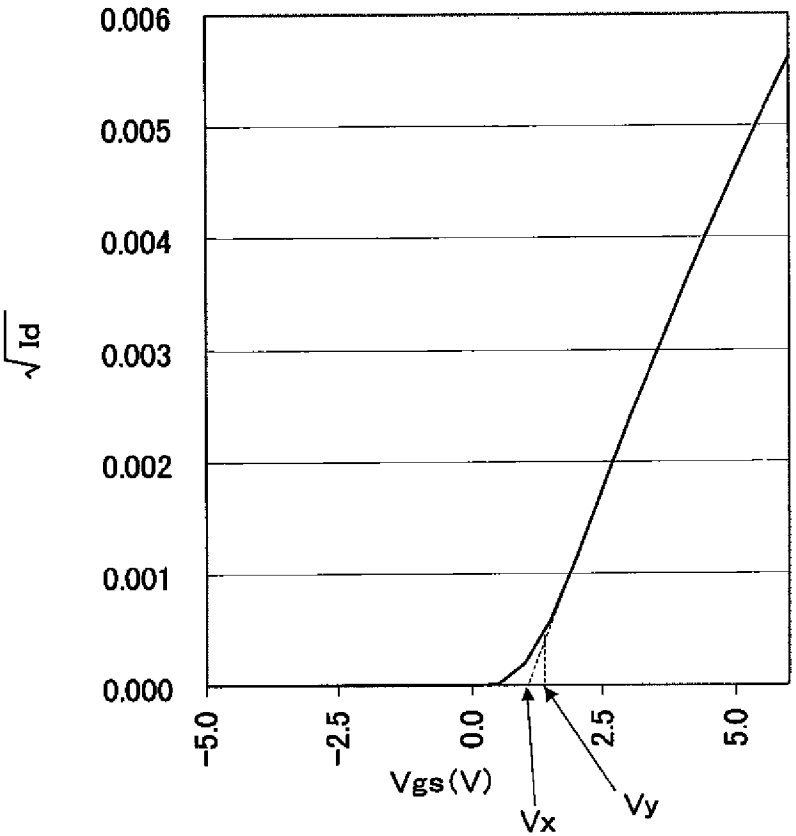
FIG. 5B is a diagram showing a relationship between Vgs and √Id.
Figure 5A:
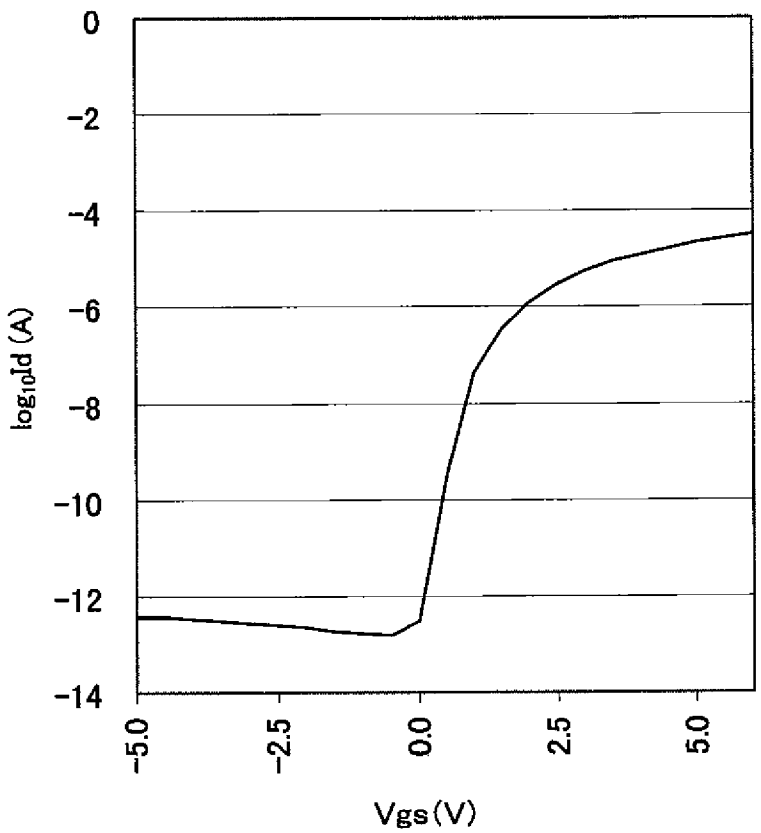
FIG. 5A is a diagram showing a relationship between Vgs and $\log_{10}$ Id.

In other words, it should be sufficient to use $f(x)=x^2$ as the function f(x). However, when the characteristics of TFTs of many panels are reviewed, it is found that the characteristic does not follow this curve in a region where (Vgs−Vth) is small, that is, a region where Id is small, and the curve tends to be flattened. FIGS. 5A and 5B show plots of the Vgs-Id characteristic of a certain TFT with the vertical axis set to represent $\log_{10}d$ and √Id, respectively.

As shown in these figures, the Vgs-Id characteristic is deviated from the square in a region where (Vgs−Vth) is small. For example, when the characteristic is approximated with a square, Vx in FIG. 5B is assumed to be Vgs in which the drain current starts to flow, that is, the Vth. In reality, however, at this voltage, a slight current flows and a dim light is emitted.

Figure 6:
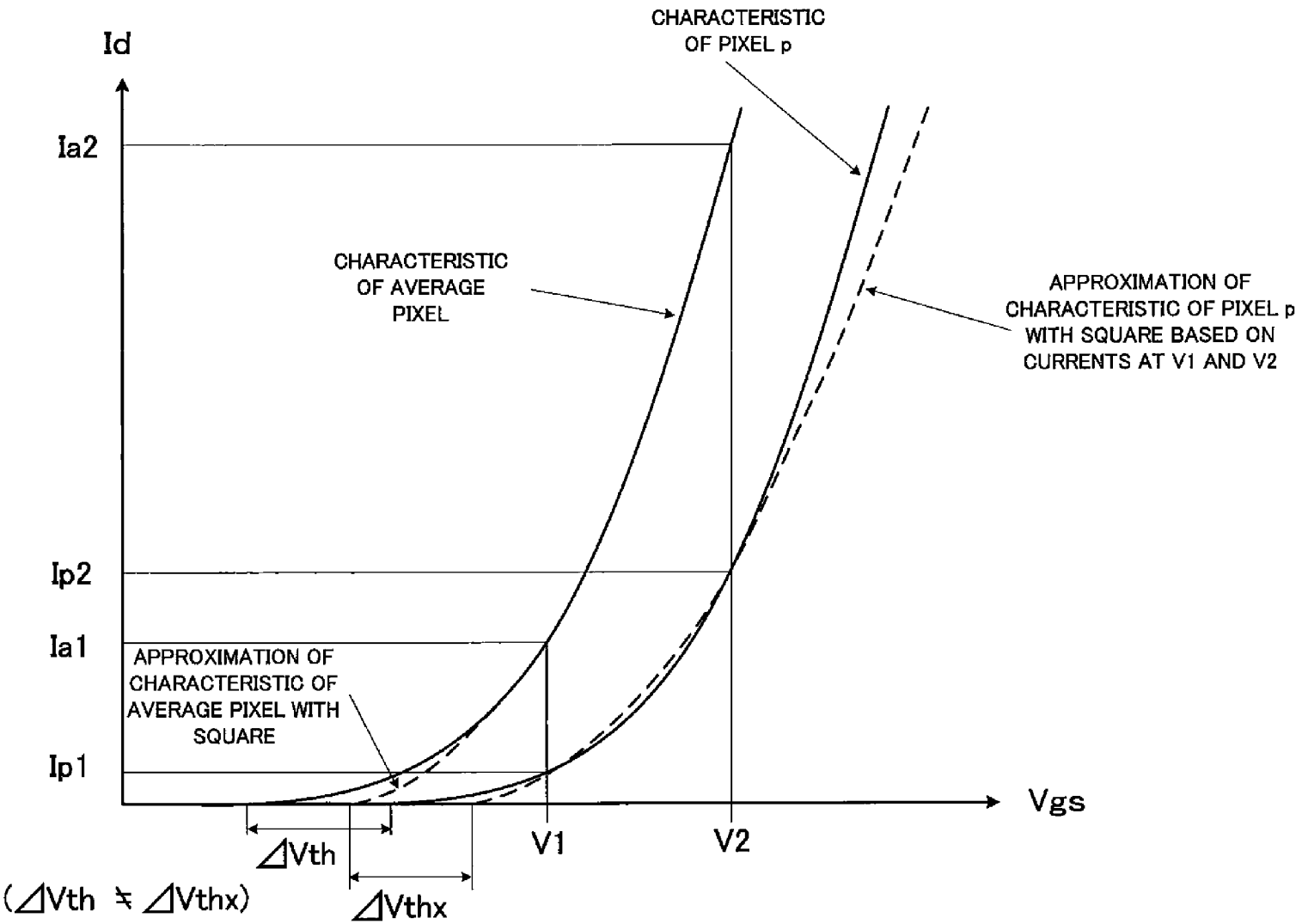
FIG. 6 is a diagram showing a relationship between Vgs and Id.

On the other hand, in the acquisition of the data for unevenness correction, the precision in the portion where the current is small, that is, a dark portion is important. FIG. 6 shows a characteristic of a pixel p having only the Vth shifted from that of the average pixel by ΔVth, and having a slope of the Vgs-Id characteristic (μ) identical to that of the average pixel. If the characteristic is approximated with an equation of the square, the Vgs-Id characteristic of the average pixel is deviated from the actual characteristic in the portion where the current is small, as shown by the dotted line. When the characteristic of the pixel p which is assumed to be approximated with an equation of the square is determined based on currents which flow when voltages V1 and V2 are applied, both ΔVth and the slope of the curve are deviated from the actual characteristics, as shown in FIG. 6. In other words, when the deviation in the approximation is large at a low current portion, the errors when the offset value and the gain value are to be calculated for each pixel become large, and accurate data cannot be acquired.

In order to accurately approximate the Vgs-Id characteristic, for example, different functions can be used between a range of 0<Vgs−Vth<Vy and for a range of Vy<Vgs−Vth, with Vy in FIG. 5B as a boundary. However, in such a configuration, the fitting of the functions including the search for the Vy point becomes complex.

In the present embodiment, the correction data is determined based on the assumption that Vgs-Id characteristics of TFTs of all pixels on the panel can be approximated with a power function of $1=(a(Vgs-b))^c$, with a value of c common to all pixels and values of a and b unique to each pixel.

Figure 7:
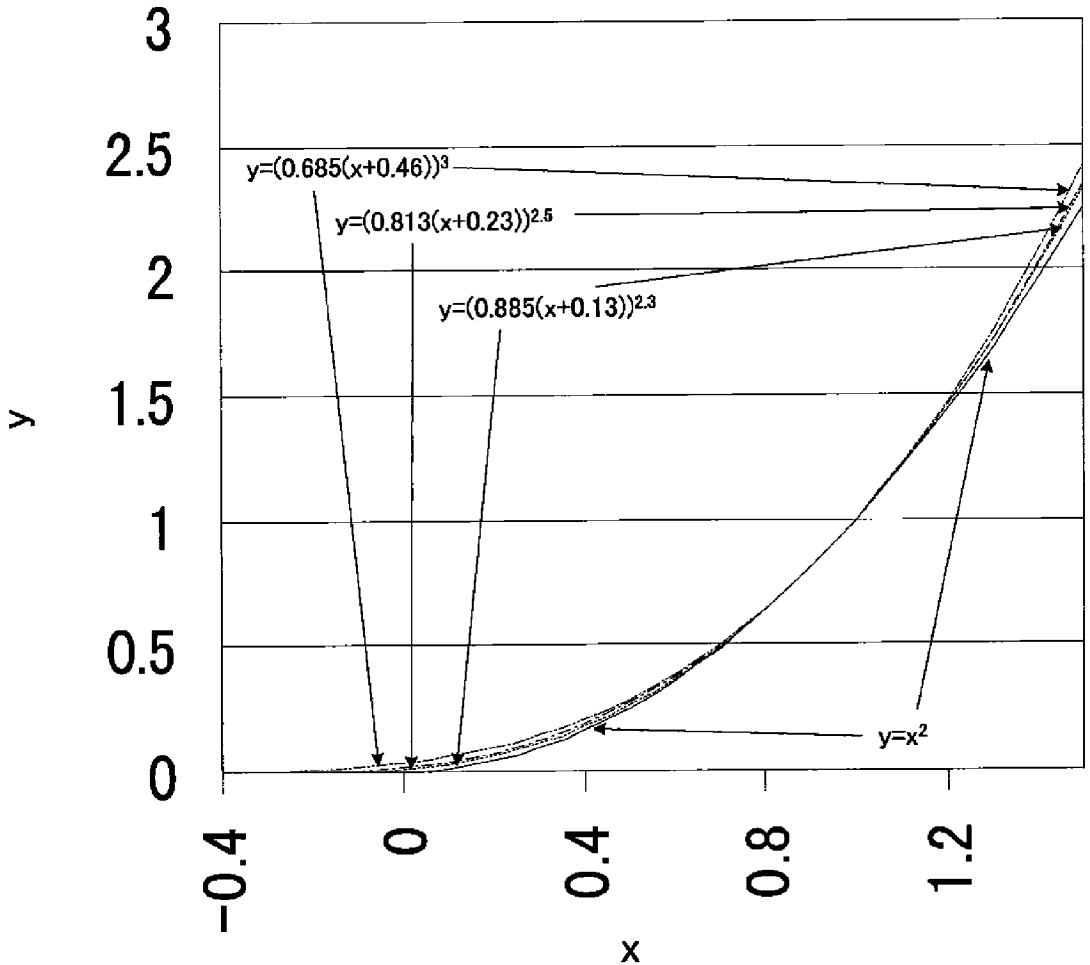
FIG. 7 is a diagram showing a relationship between x and y with regard to a power function of x.
Figure 8:
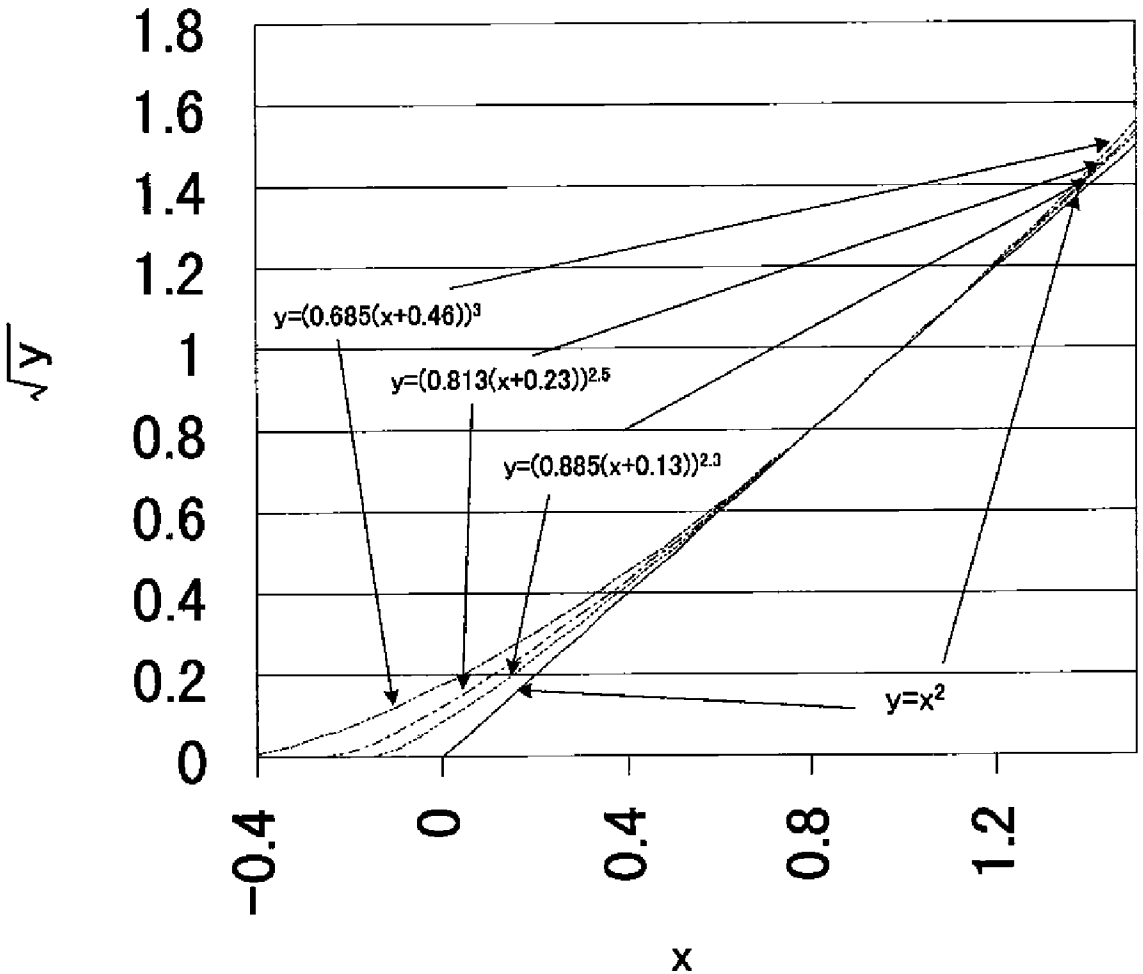
FIG. 8 is a diagram showing a relationship between x and √y with regard to a power function of x.

FIG. 7 shows graphs when c is 2, 2.3, 2.5, and 3, respectively, under a condition that y=1 when x=1. FIG. 8 is a graph re-plotting these graphs with the horizontal axis set to represent √y. If the slight deviation in the case when x>1 can be tolerated, the curve when x is very small approaches the curve of the TFT when c>2. Therefore, by assuming that the TFT characteristic can be approximated with a power function, the function f(x) can be relatively easily determined.

Next, steps for determining the correction data will be described. A QVGA panel (320 in the vertical direction and 240 in the horizontal direction x RGB=720) in which a pixel is constructed with three sub-pixels (dots) is considered. In this case, the total number of dots is 230400 dots. First, 500 dots among the total number of dots are used to measure the Vgs-Id characteristic of an average TFT. Because the characteristics of the organic EL material which becomes the load differ depending on the colors, the Vgs-Id characteristic can slightly differ among the colors. Therefore, a more precise correction can be achieved if the TFT characteristic which forms the standard is measured for each color and different curves are used for different colors. However, in the present embodiment, one representative TFT characteristic is considered regardless of the colors. In order to permit determination of a truly average characteristic of the panel, it is preferable that the dots are randomly chosen from various locations on the panel. Alternatively, if TFT characteristics around the center of the panel are to be assigned a higher priority, the dots can be randomly chosen from areas near the center.

Figure 9A:
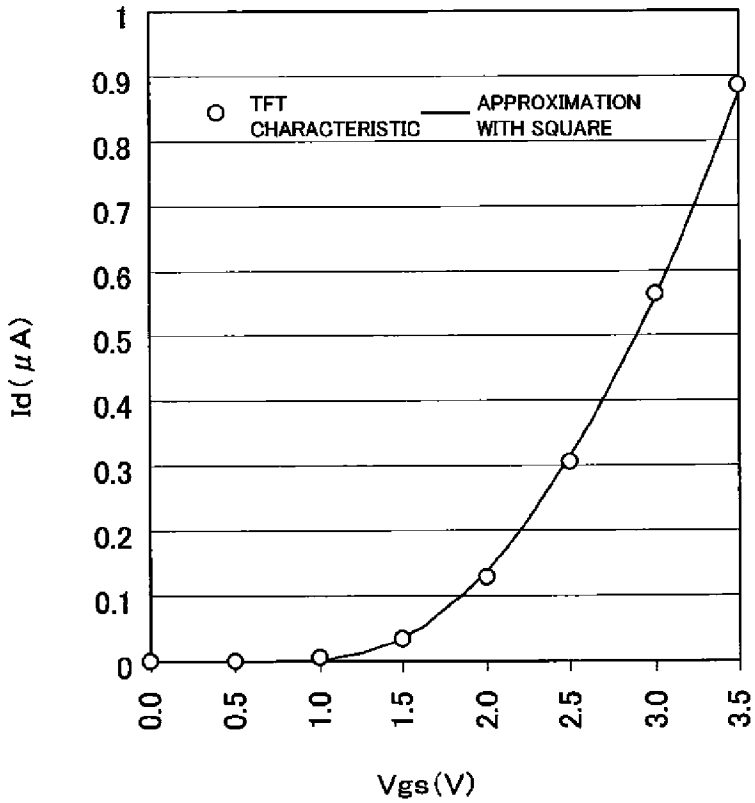
FIG. 9A is a diagram showing a relationship between Vgs and Id when the characteristic of the TFT is approximated with square.
Figure 9B:
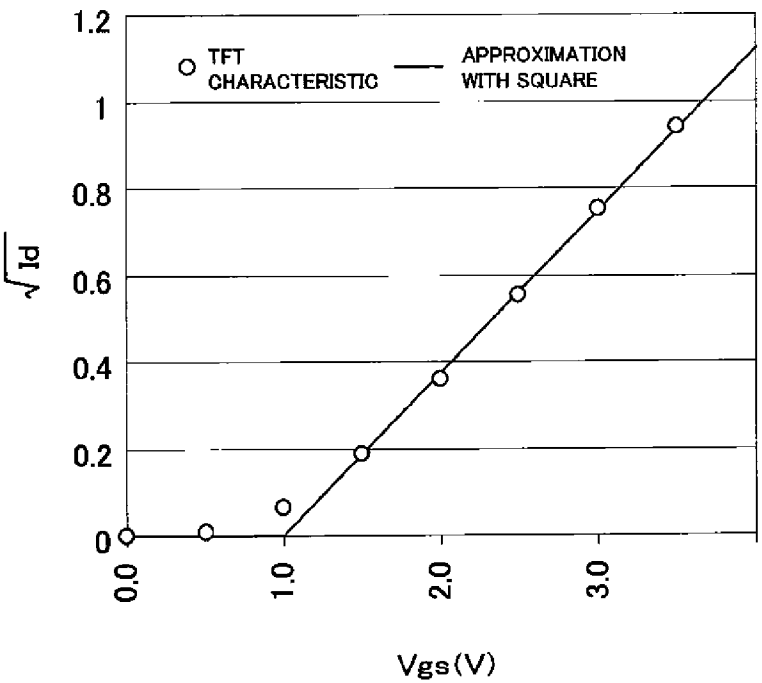
FIG. 9B is a diagram showing a relationship between Vgs and √Id when the characteristic of the TFT is approximated with square.

The dots are switched ON dot by dot, Vgs is changed from 0 V to 3.5 V by a step of 0.5 V as shown in FIGS. 9A and 9B, and the current flowing in each case is measured. The measurement results of the currents of 500 dots are averages for each input voltage, and the average current value is plotted for each voltage.

Because the above-described method averages the measured values, the above-described method is effective when the error and noise during measurement is large, and the calculation for determining the approximation function needs to be executed once. Alternatively, the characteristic of the average pixel can be determined by determining coefficients a, b, and c for each of the pixels of 500 dots and determining average values of the coefficients. When the error and noise during measurement is small, such a method leads to a more accurate average characteristic, but a calculation for determining the approximation function must be executed for times corresponding to the number of dots (in the example configuration, 500 times), and the method is time-consuming.

FIG. 9A is a diagram plotting a current value determined in this manner, and a curve approximated with an equation of square is shown in an overlapping manner. When the same data is re-plotted with the vertical axis being set to represent √Id as shown in FIG. 9B, it can be understood that the deviation is large at the portion where Vgs is low.

Figure 10B:
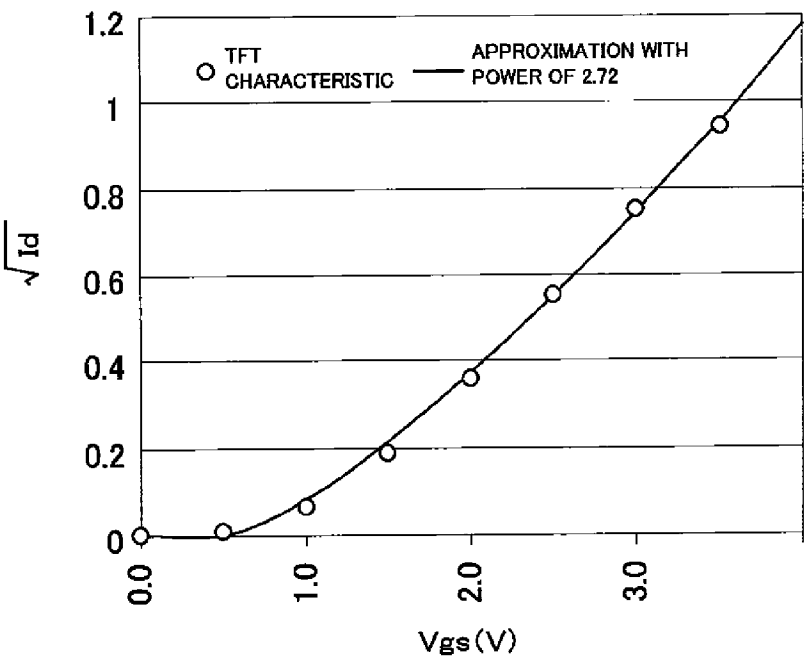
FIG. 10B is a diagram showing a relationship between Vgs and √Id when the characteristic of the TFT is approximated with a power of 2.72.
Figure 10A:
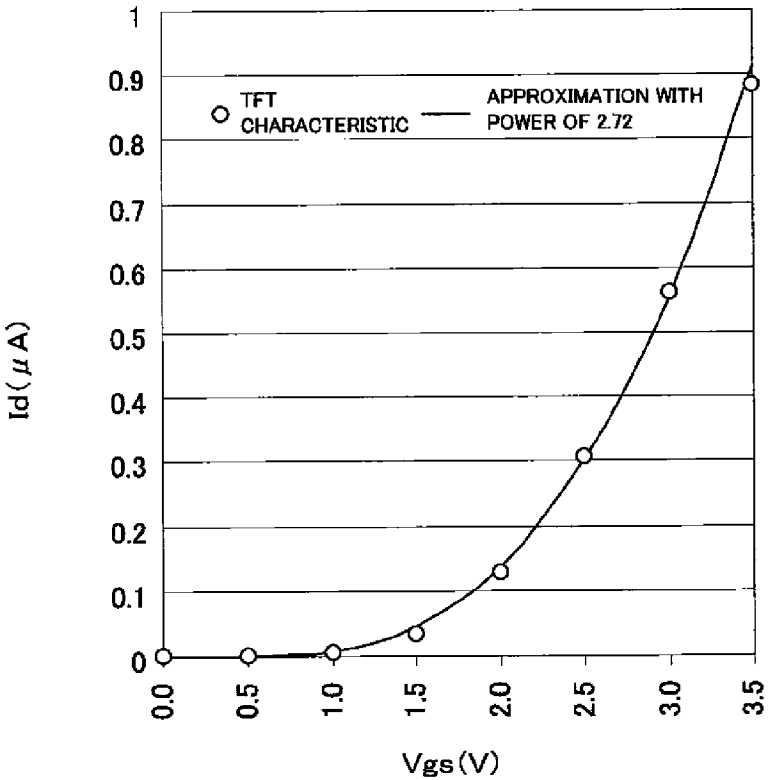
FIG. 10A is a diagram showing a relationship between Vgs and Id when the characteristic of the TFT is approximated with a power of 2.72.

FIG. 10A shows, in an overlapping manner, a curve which approximates the characteristic of the same TFT with an equation of a power of 2.72. In this case, even when the same data is re-plotted with the vertical axis being set to represent √ID, the deviation at the portion where Vgs is low is small (FIG. 10B).

Figure 11:
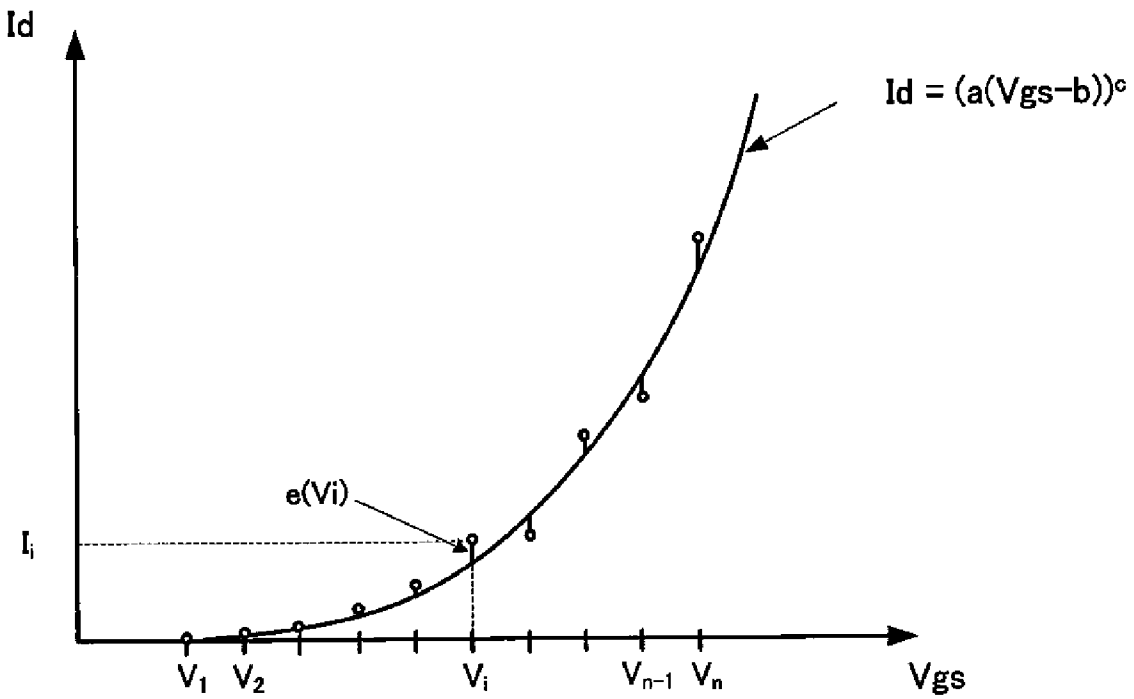
FIG. 11 is a diagram showing a state of approximation by a method of least squares.

As the actual calculation method of the coefficients of the approximation equation, a method of least squares which is commonly used can be used. In FIG. 11, if a sum of squares of the differences between the measurement data and the function $Id=(a(Vgs-b))^c$, that is, residuals, $$e(Vi)=(a(Vi-b))^c-Ii \quad \text{[Equation 5]}$$

is J, J can be represented by:

$$J=\Sigma(e^2(Vi))=\Sigma((a(Vi-b))^c-Ii)^2[I=1\sim n] \quad \text{[Equation 6]}$$

The values of a, b, and c can be determined to minimize J.

In this example configuration, because the characteristic is approximated by $Id=(0.046(Vgs-0.5))^{2.72}$, values of a, b, and c are a=0.046, b=0.5, and c=2.72.

Then, values of a' and b' for all dots of the panel are determined based on the values of a, b, and c. Because c is a common value for the curves of all dots, the unknown variables are a' and b', which can be determined by solving the following system of simultaneous equations with two unknowns with measurement of drain current values (I1 and I2) at two or more gate voltages (V1 and V2).

$$I1=(a'(V1-b'))^{2.72},\ I2=(a'(V2-b'))^{2.72} \quad \text{[Equation 7]}$$

In other words, by applying two gate voltages to all dots and measuring the currents which flows when the gate voltages are applied, the values of a' and b' for each dot can be easily determined.

Figure 12:
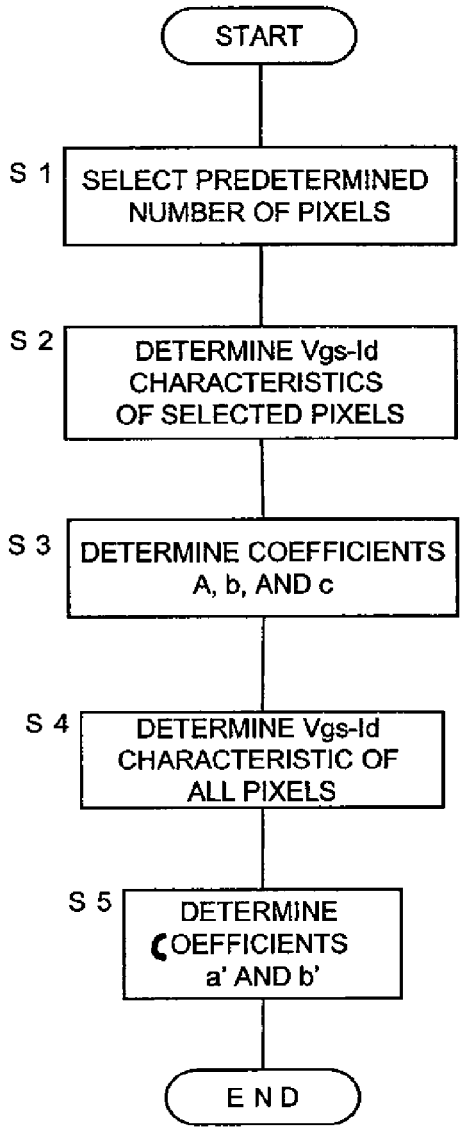
FIG. 12 is a flowchart showing steps of the process.

As described, in the present embodiment, coefficients a, b, and c are determined through steps as shown in FIG. 12. First, a predetermined number of pixels are selected (S1), input voltage (Vgs)—current (Id) characteristics are determined for the selected pixels (S2), an average Vgs-Id characteristic is determined based on the determined Vgs-Id characteristics, and coefficients a, b, and c are determined by the method of least squares based on the average characteristic (S3). After the coefficient c is determined in this manner, currents (Id) are determined at two or more input voltages (Vgs) for each of the pixels (S4), and the values a' and b' are determined using the determined coefficient c (S5).

As described, in the present embodiment, an average Vgs-Id characteristic of a panel is determined, a coefficient c common to all pixels is determined based on the average Vgs-Id characteristic, and values a and b for each pixel are determined using the common coefficient c. Therefore, correction data (a' and b') of all pixels can be acquired with a relatively easy operation, and a correction with a high precision can be executed with the correction data.

The coefficient c corresponds to the correction in the γ correction circuit 16. The γ correction circuit 16 of the present embodiment is formed as a lookup table, and brightness data which is highly accurate can be obtained by the above-described correction with a power function (power of 2.72 in the above-described example configuration). Therefore, a circuit which calculates $x^{1/c}$ with respect to input image data x and outputs corrected image data can be used as the γ correction circuit 16. The coefficient c in this case is preferably set to a different value for each color.

The invention has been described in detail with particular reference to certain preferred embodiments thereof, but it will be understood that variations and modifications can be effected within the spirit and scope of the invention.

PARTS LIST

2 selection TFT
1 driving TFT
3 organic EL element
10 source driver
10*a* data latch
10*b* D/A
12 gate driver
14 pixel sections
16 γ correction circuit
18 pixel region
20 calculating unit
20*a* correction gain generating circuit
20*b* correction offset generating circuit
20*c* multiplier
20*d* adder
22 transferring circuit
24 memory
26 generating circuit

The invention claimed is:

1. A method of displaying an image with unevenness correction on an organic electroluminescence display device, comprising:

(a) providing the organic electroluminescence display device having a plurality of pixels, each including a transistor;

(b) measuring respective first Vgs-Id characteristics of the transistors in each of a selected first plurality of pixels;

(c) calculating one or more second Vgs-Id characteristics using the measured Vgs-Id characteristics;

(d) calculating one or more first approximation functions using the second Vds-Id characteristics, wherein each approximation function is defined by the equation having three values a, b and c:

$$Id=(a(Vgs-b))^c$$

for corresponding sets of values a, b and c calculated so that each first approximation function approximates the corresponding second Vds-Id characteristic;

(e) calculating a value c' using the one or more first approximation functions;

(f) measuring respective third Vgs-Id characteristics of the transistors in each of a selected second plurality of pixels;

(g) calculating, for each third Vgs-Id characteristic, a second approximation function using the corresponding third Vds-Id , wherein each second approximation function is defined by the equation having two values a' and b', and the value c' calculated in step (e):

$$Id=(a'(Vgs-b'))^c$$

for corresponding sets of values a and b and the calculated value of c so that each second approximation function approximates the corresponding third Vds-Id characteristic;

(h) receiving an image data signal for each of the plurality of pixels;

(i) calculating a plurality of corrected image signals using the respective image data signals and the respective second approximation functions of the corresponding pixels of the display device to correct for unevenness; and (j) applying each corrected image signal to the corresponding pixel of the display device to display a corresponding image with unevenness correction.

2. The method of claim 1, wherein step (c) includes calculating a single second Vgs-Id characteristic using all of the first Vgs-Id characteristics, and wherein step (d) includes calculating a single first approximation function using the single second Vds-Id characteristic.

3. The method of claim 1, wherein step (d) includes calculating a respective first approximation function using each second Vgs-Id characteristic, and wherein step (e) includes averaging the values for c of each first approximation function to calculate the value for c'.

4. The method of claim 1, wherein the second plurality of pixels includes each pixel in the first plurality of pixels.

5. The method of claim 1, wherein step (j) includes calculating first and second values corresponding to each image data signal using corresponding values a' and b', multiplying the image data signal by the first value, and adding to each image data signal the second value to produce the corresponding corrected image signal.

* * * * *